US008113860B2

(12) United States Patent
Sandwith

(10) Patent No.: US 8,113,860 B2
(45) Date of Patent: Feb. 14, 2012

(54) HIGH POWER MULTI-PIN ELECTRICAL CONNECTOR

(76) Inventor: Graeme Richard Sandwith, Chicago, IL (US)

( * ) Notice: Subject to any disclaimer, the term of this patent is extended or adjusted under 35 U.S.C. 154(b) by 0 days.

(21) Appl. No.: 12/554,542

(22) Filed: Sep. 4, 2009

(65) Prior Publication Data

US 2011/0059638 A1 Mar. 10, 2011

(51) Int. Cl.
*H01R 13/52* (2006.01)

(52) U.S. Cl. ..... 439/271; 439/936

(58) Field of Classification Search ..... 439/271, 439/276, 278, 283, 587, 936
See application file for complete search history.

(56) References Cited

U.S. PATENT DOCUMENTS 2,897,471 A * 7/1959 De Tar ..... 439/275
4,690,478 A * 9/1987 Rahrig et al. ..... 439/271
5,372,516 A * 12/1994 Maeda ..... 439/271

* cited by examiner

*Primary Examiner* — Javaid Nasri
(74) *Attorney, Agent, or Firm* — Roy Kiesel et al

(57) ABSTRACT

This patent discloses an improved multi-pin electrical connector for use in wet environments. Multi-pin connectors are widely used. In some uses, the connectors may be exposed to water. The improved connector keeps external water from entering the connector and isolates any water inside the connector. A number of improvements are disclosed, including seals for the pins, seals for the wires exiting the back of the connector, and bonding internal insulator materials. The invention also incorporates an improved female receptacle design that provides a better male-to-female connection, thus improving performance of the connector. The multi-pin connector disclosed is suitable for use in almost any wet environment.

24 Claims, 6 Drawing Sheets

HIGH POWER MULTI-PIN ELECTRICAL CONNECTOR

FIELD OF THE INVENTION

The invention relates to a multi-pin electrical connector, and more particularly to such a connector that is suitable for use in a wet environment.

BACKGROUND OF THE INVENTION

Multi-pin electrical connectors are commonly used in a broad range of industrial applications, including medical equipment, factory automation, heavy equipment, instrumentation, motion control, rail mass transportation, and natural resource exploration. The typical multi-pin connector has a set of pins on one half of the connector (the male part) and a set of mating sockets in the other half of the connector (the female part). Generally, each pin and socket combination is used for a separate electrical circuit while all of the pin/socket sets are contained in a common connector shell. This allows all pins to be connected or disconnected at the same time, allowing ease of use and ensuring that each pin is correctly mated to its matching socket. The pins are closely spaced in order to fit within a single shell. This design is beneficial because it reduces the size and weight of the connector.

There are, however, problems when multi-pin connectors are used in wet environments. This can occur in many industrial settings. In natural resource exploration and removal (e.g., in the oilfield industry), it is not unusual to be operating in wet conditions. Other situation may also involve wet conditions at times. Outdoor entertainment, events like concerts or fairs, will sometimes experience wet conditions. Some manufacturing is done in wet conditions. Vehicles, from motorcycles to locomotives to ships all operate in wet conditions.

When a multi-pin connector is used in a wet environment, there is a risk that water will enter the connector and effectively create new electrical flow paths within the connector. These connectors have multiple electrical connections close together, with each line carrying a separate signal that needs to remain isolated from other signals. When water makes contact with more than one set of connections, cross-talk between the two signals may occur. Signal deterioration or even complete signal loss can result. The water becomes a new circuit within the connector and effectively interconnects signals that must remain isolated for proper operation.

Depending upon the use of the connector, this type of problem can have catastrophic consequences. Control signals could be lost and certain equipment may malfunction as a result. Loss of property, injury to workers, and economic loss due to down time may follow. If a multi-pin connector on a locomotive fails due to wet conditions, the train might miss a signal to change tracks and collide with another train. In almost any context where multi-pin connectors can be exposed to wet conditions, there is the risk of serious damage or loss if the connectors fail.

There is, therefore, a need for a multi-pin electrical connector that will operate in wet conditions without risk of failure. Because there are a number of ways that water might enter into a multi-pin connector, the improved connector would need to incorporate a number of distinct improvements. The current invention meets these needs.

SUMMARY OF THE INVENTION

The invention is an improved multi-pin connector suitable for wet conditions. When a multi-pin connector is used in wet conditions, it must be assumed that water may exist in any open space within the connector. This fact poses a significant challenge. Indeed, this fact shows that trying to design a multi-pin connector that has no water anywhere within the connector is probably an exercise in futility.

The current invention solves these problems by isolating all contact areas from each other. By doing so, the invention allows for the possibility that water may get into the area around the contacts before the two parts of the connection are made up. When the male and female parts are connected together, the invention uses a number of seals that create isolated pockets of water. These pockets of water cannot reach each other and connect create a path from one internal connection to another.

The accomplish this result, the invention uses a flexible seal around the base of each pin on the male part of the connector. The opening at the end of the female receptacle has a bevel. When the male and female are connected, the flexible seal mates with the bevel surface and provides a good seal around each female opening. The seal expands outward when the connection is made up, and thus seals the connection. Each pin/socket connection is sealed in this way.

The invention also uses seals at the back of each part of the connector. Wires exit from the back of both parts of the connector. A flexible seal is used inside the wire openings to seal the wires to the insulator body. In addition, the invention uses an overmolding process to bond the different insulator materials uses in each part of the connector. These improvements allow the connector to operate in wet conditions with minimal risk of failure.

The invention also uses an improved female socket. The female receptacle has a longitudinal slot so that the receptacle can slightly increase or decrease in diameter. A cylindrical spring sleeve surrounds the socket and applies a small force to slightly reduce the diameter of the socket. A male pin must slightly expand the female socket when the connection is made up. This improvement provides a wiping action, thus cleaning the surface of the male pin, which was exposed to the environment prior to making up the connection. This improvement also creates a better contact between the male and female, thus improving signal quality.

BRIEF DESCRIPTION OF THE DRAWINGS

FIG. 2 is an illustration of the cross section of the back end of a connector where the wires exit the connector.

DETAILED DESCRIPTION OF THE INVENTION

The problem water poses to multi-pin connectors is due to the electrical conductivity of the water and the numerous electrical contacts in close proximity to each other. The conductivity of water varies depending upon how many other substances are in the water. Pure water is a very poor conductor. But the water found in most industrial environments (e.g., sea water, rain, tap water, etc.) is a good enough conductor to pose problems.

A multi-pin electrical connector requires complete electrical isolation of each separate electrical line within the connector. Every pin and receptacle pair must be electrically isolated from all other pins and receptacles. If a continuous path of water exists between a conductor of one line and a conductor of another line, the water may form an electrical connection between the two conductors. This unintended and undesirable cross-connection between electrical contacts carrying separate signals creates cross talk.

The problem posed by cross talk varies depending upon the nature of the signals and the conductivity of the electrical path between the separate signal lines. When the conductivity between the conductors of the separate signals is low, the cross talk is low and may not pose significant problems. But when the conductivity is relatively high, cross talk can result in complete loss of a signal, extreme interference between signals, or spurious signals. As explained above, these situations can lead to catastrophic results.

Figure 1A:
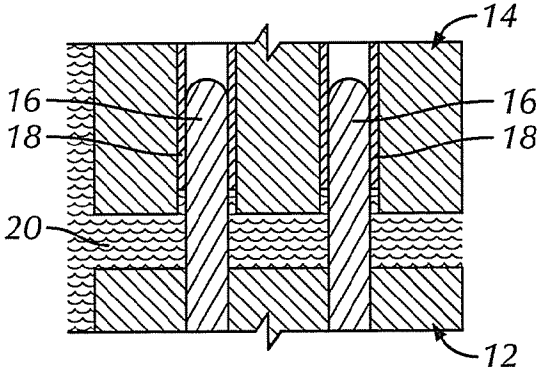
FIG. 1A (Prior Art)
FIG. 1A is an illustration of the cross section of the male-to-female connection area of a prior art connector and FIG. 1B is an illustration of the cross section of the male-to-female connection area of the current invention.
Figure 1B:
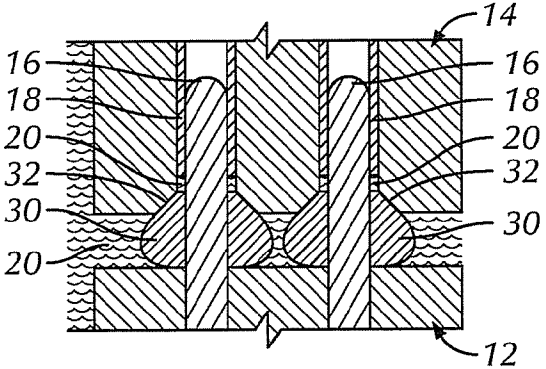

The first three figures illustrate three ways water can lead to cross talk in a multi-pin connector. FIGS. 1A and 1B illustrates the point of connection of the male component 12 and female component 14 of a multi-pin electrical conductor 10. When the two components are connected together, pins 16 are inserted into receptacles 18. As FIGS. 1A and 1B illustrates, the male contact end 24 and the female contact end 26 do not actually come into contact with each other when the connector is made up. Various factors contribute to this result, including manufacturing tolerances and, in some instances, debris.

As a result, a small gap exists between the male contact end 24 and the female contact end 26, and water 20 may remain in this gap. This water 20 will be in physical and electrical contact with the pins 16 and, in some instances, with receptacles 18, as well, as shown in FIG. 1A. The water 20, therefore, may create an unintended and undesired electrical connection between pins, between receptacles, or combinations of the two, thus causing cross talk in the prior art connector shown in FIG. 1A.

The present invention solves this problem. The base of the pins 16 are surrounded by flexible seals 30, as shown in FIG. 1B. When the male component 12 and female component 14 are pushed together, the flexible seals 30 are deformed radially outward as illustrated in FIG. 1B. There are beveled openings 32 on the female contact end 26 where the pins 16 enter the female component 14. The base end of each flexible seal 30 is connected to the male contact end 24 and the other end seats against the beveled openings 32, thus completely sealing off every pin 16 when the connection is made up.

The present invention does not keep water out of the multi-pin connector 10. Instead, the invention isolates the water in two ways. First, any water 20 remaining in the small gap between the male contact end 24 and the female contact end 26 is isolated from the pins 16, thus preventing cross talk due to such water. Second, it is possible for very small pockets of water 20 to remain trapped in the area around the pins 16 and receptacles 18. This too is illustrated in FIG. 1B. Such small pockets of water are isolated to each pin/receptacle contact area, and therefore, cannot complete an electrical connection to any other pin/receptacle pair. In this manner, the present invention prevents water in the contact area from causing cross talk.

Figure 2A:
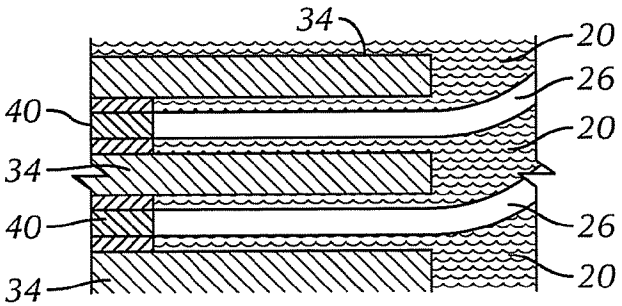
FIG. 2A (Prior Art)
FIG. 2A illustrates a prior art design and FIG. 2B illustrates the current invention.
Figure 2B:
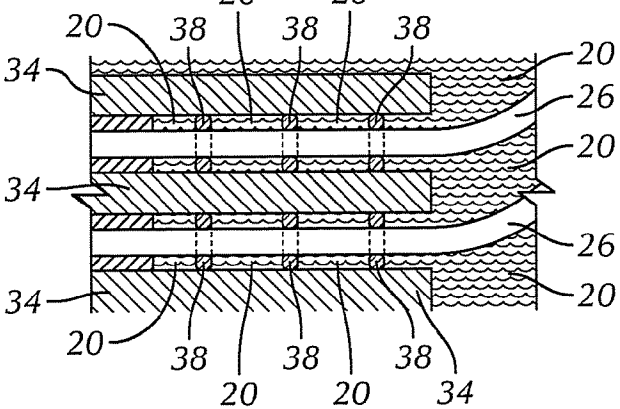

FIGS. 2A and 2B illustrates a second way that water can lead to cross talk. In these drawings, a first cable end 34 of a male component 12 is illustrated. Wires 26 are shown exiting the connector. These wires typically are grouped into a cable that extends from the end of the connector. When a connector of this type is used in a wet environment, water 20 may enter the area around the wires 26 and may reach the connection between the wires 26 and either the pins 16 (i.e., for a male component 12) or the receptacles (i.e., for a female component 14). If water 20 reaches the electrical contacts of two or more lines, an electrical connection may be created, thus causing cross talk, as shown in FIG. 2A.

The present invention solves this problem by using one or more flexible, cylindrical seals 38 near the cable end 34 of the connector, as shown in FIG. 2B. These seals 38 form a watertight seal between the body of the connector and the wires 26. As in the explanation above, this solution does not eliminate water 20 from the internal parts of the connector. Instead, this solution, as shown in FIG. 2B, isolates pockets of water 20 from each other, and thus prevents such water 20 from creating electrical connections between separate lines. This isolation prevents cross talk.

Figure 3A:
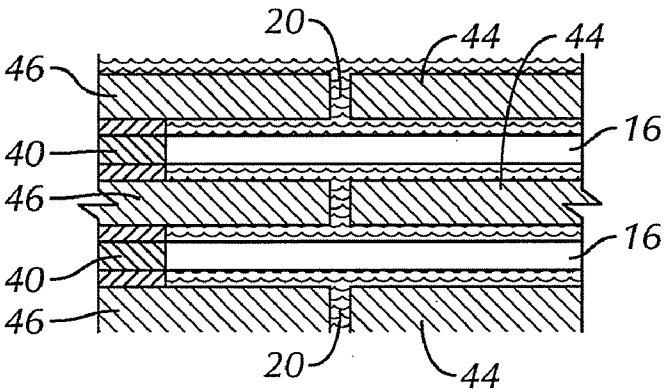
FIG. 3A (Prior Art)
FIG. 3A is an illustration of the cross section of the area where two different insulator materials meet within a prior art connector and FIG. 3B is an illustration of the cross section of the area where two different insulator materials meet within the current invention.
Figure 3B:
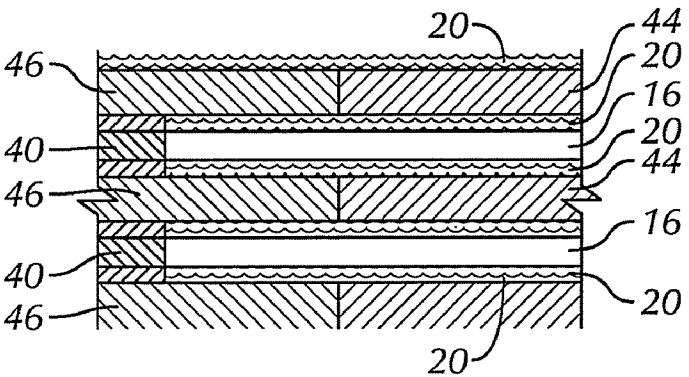

FIGS. 3A and 3B illustrates yet another way that water can lead to cross talk in a multi-pin connector. An internal portion of a male component 12 is illustrated, and two different insulator materials are shown where they meet. A flexible insulator 44 is shown on the right side of FIGS. 3A and 3B, and would typically be used at the cable end 34 of the male component. A rigid insulator 46 is shown on the left side of FIGS. 3A and 3B, and would typically be used internally in the male component. The pins 16 extend across this connection point between the two insulators. Wires 26 are shown with connections 40, as well.

In prior art devices, as shown in FIG. 3A, the two insulator pieces are not physically bonded to each other. This configuration can allow very small spaces to exist between the two insulator pieces, and water 20, can enter such spaces, as shown in FIG. 3A. When this happens, the water 20 may be in contact with a number of pins 16, thus causing cross talk.

The present invention solves this problem by permanently bonding the different insulator pieces together, as shown in FIG. 3B. An over molding process is used in a preferred embodiment, but the insulator pieces could be glued or bonded in other ways. The bond eliminates all gaps between the insulator pieces, as shown in FIG. 3B, and thus eliminates the third process through which water can lead to cross talk in multi-pin connectors.

Figure 4:
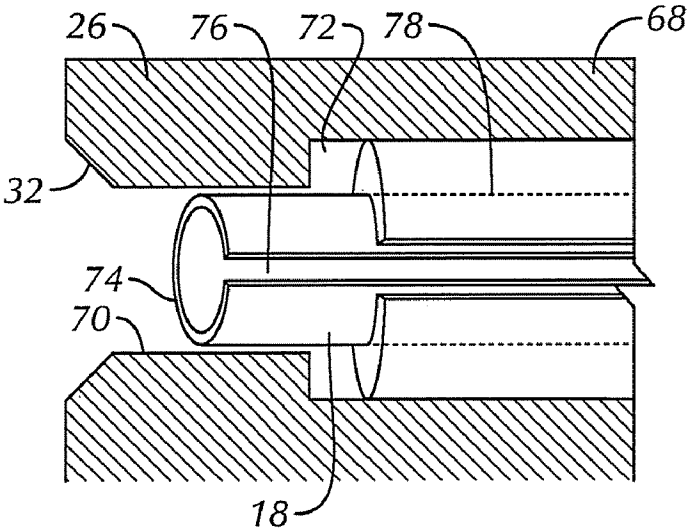
FIG. 4 is an illustration of the cross-section of the female receptacle of the present invention.

FIG. 4 is an illustration of certain parts of the female component 14. The area near the female contact end 26 is shown. This part of the female component 14 is typically made of a rigid insulator 68 (such as glass-reinforced phenolic), which maintains rigidity and structural integrity. The end of a longitudinal socket 70, with a beveled opening 32, and a larger diameter region 72.

A receptacle 18 is shown within socket 70. A first end of the receptacle 74 is positioned near the female contact end 26, but does not extend all the way to the beveled opening 32. By recessing the receptacle 18 a short distance within the insulating socket 70, safety is increased because the risk of inadvertent contact with a receptacle 18 is reduced.

The receptacle 18 has a longitudinal slot 76 extending from the first end 74. Though not shown in this illustration, the slot may extend along about half the length of the receptacle 18. The slot 76 may extend along the entire length of the receptacle 18. For best performance it is recommended that the slot 76 extend at least as far and the pins 16 will be inserted into the receptacles 18.

A cylindrical spring sleeve 78 is positioned in the larger diameter region 72 of the socket 70. This sleeve surrounds part of the slotted portion of the receptacle 18. The spring sleeve is biased closed, that is, it tends to try to close the gap in the sleeve, and thus squeeze the receptacle slot closed, as well. The result is that the receptacle 18 has a slightly smaller diameter that in its resting state.

In operation, the components illustrated in FIG. 4 improve the electrical connection between pin 16 and receptacle 18 in two ways. First, a pin 16 must be forced into the receptacle 18 by slightly expanding the slotted part of the receptacle and the spring sleeve 78. This action creates a wiping effect that cleans the outer surface of the pin 16. This wiping eliminates some water and debris from the pins 16, and allows for a cleaner connection. Second, the spring sleeve 78 applies a small force to the slotted part of the receptacle 18, and keeps the receptacle in better physical contact with the pin 16, which also improves the electrical connection.

Figure 5:
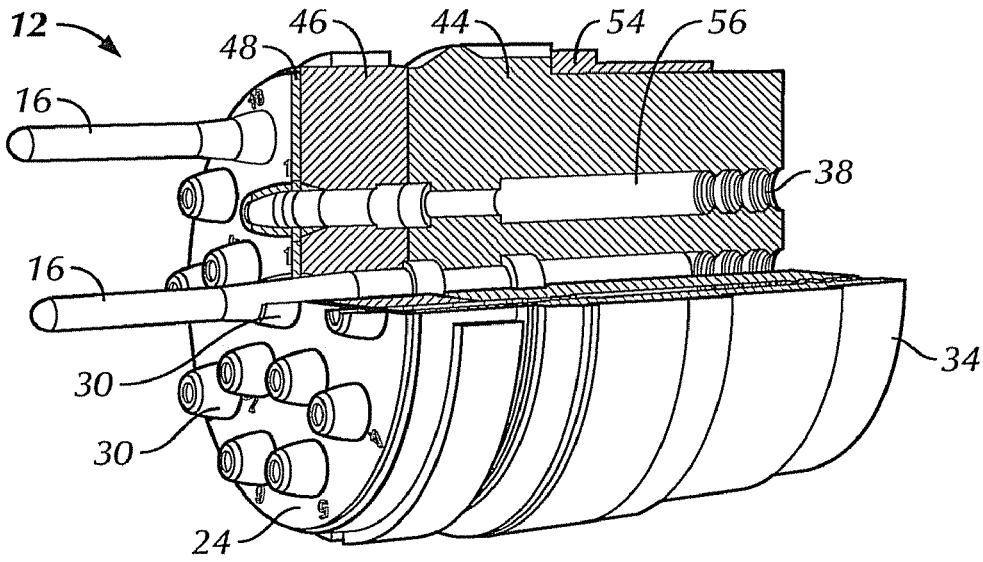
FIG. 5 is a cut-away illustration of part of the male component of the present invention.

The illustrations described above provide a helpful explanation for some of the key features of the invention. The remaining drawings show how these features may be embodied in the invention by presenting a preferred embodiment of the invention. FIG. 5 shows a male component 12, which has a contact end 24 where the pins 16 extend outward. The opposite end is the male cable end 34. The flexible seals 30 are shown around the base of two pins 16 and also over the end of sockets 56 with no pins. During the assembly of the male component, the pins 16 are pushed into place within the sockets 56. FIG. 5, with only two pins 16 shows a male component 12 at an early stage of the final assembly process.

The body of the male component 12 is made of three insulator layers. Started from the cable end 34, a first layer of insulator material 44 is made of a flexible material (e.g., silicon). In the embodiment shown, the first insulator layer 44 is the largest (i.e., thickest) of the insulator layers. It provides for flexibility that aids in the assembly process and helps form tight seals around pins positioned within the insulator body. The middle insulator layer 46 is made of a rigid material, such as glass-reinforced phenolic. This rigid layer 46 is positioned near the contact end 24, and thus provides substantial strength and rigidity to the pins 16. The rigid material greatly reduces the flexibility and side-to-side motion of the pins, which is a desirable result. This rigidity facilitates mating the multiple pins 16 with their corresponding receptacles 18 of the female component 14. In a preferred embodiment, the rigid layer 46 is thinner than the first layer of flexible insulator material 44.

A thin, flexible insulator layer 48 is used on the surface of the contact end 24, in order to provide a tight seal around the pins 16. In a preferred embodiment, this flexible insulator layer 48 is substantially thinner than the rigid layer 46 and the first flexible insulator layer 44. The thin, flexible insulator layer 48 is used to provide flexible material on the face of the male contact end 24, which enhances the seal around the base of each pin 16.

The three insulator layers are securely and permanently bonded to each other. A variety of bonding methods may be used, but an overmolding process is preferred. This process produces a strong chemical bond between insulator materials. The flexible seals 30 are connected to the thin, flexible insulator layer 48.

Two additional features of importance are shown in FIG. 5. Near the cable end 34, the sockets 56 have three flexible, cylindrical seals 38. These seals 38 provide a water-tight seal around the wires that are later connected to the pins 16. Three such seals 38 are shown, and two or more seals are preferred, but a single seal is also within the scope of the invention.

Finally, a rigid outer support ring 54 is shown around the outside of the large, flexible insulator region 44. This ring is located near the cable end 34, and provides additional strength to that portion of the connector. The support ring 54 may be installed after all the pins 16 are in place, and thus the large flexible insulator region 44 makes installing the pins 16 easier, and the support ring 54 then provides some additional rigidity to the insulator region 44. This result is desirable because the more the cable end 34 flexes side-to-side, the greater the risk of water movement past the flexible cylindrical seals 38.

Figure 6:
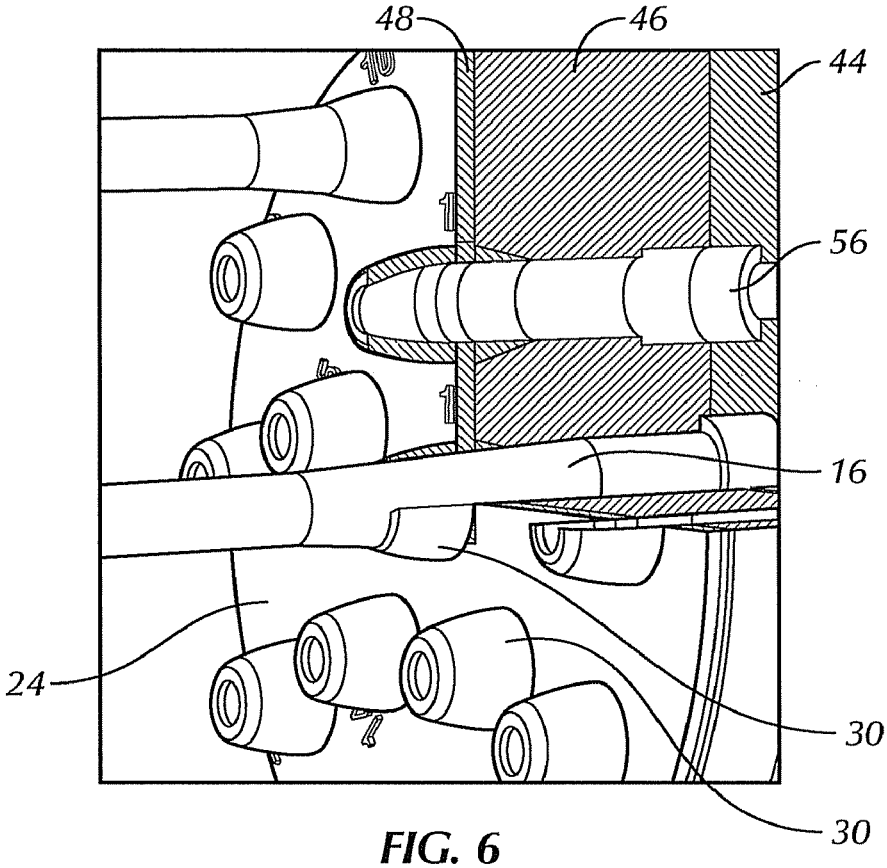
FIG. 6 is a much enlarged version of a portion of FIG. 5.

FIG. 6 is an enlarged version of part of FIG. 5. The thin flexible insulator layer 48 at the contact end 24 is shown in more detail, as are the flexible seals 30 that surround the base of the pins 16. The rigid insulator layer 46 and a small part of the large, flexible insulator region 44 are also shown. It can also been seen in FIGS. 5 and 6 that the sockets 56 may have larger diameter sections to receive larger sections of the pins 16. This configuration makes the pins more secure longitudinally, and thus, less likely to be pushed back into the connector during use. This configuration also enhances the seal between the body of the pins 16 and the insulator materials. In particular, the flexible first insulator layer 44 produces good internal seals against the body of the pins 16, because the flexible material allows for a tight fit around the pins 16.

Another preferred, but non-essential, feature of the male connector is shown in FIG. 6. The pins 16 extend outwardly from the male contact end 24. A base section of the pins 16 can be defined as that region of the external portions of the pins that is nearest the male contact end 24. As shown in FIG. 6, the base section of the pins may be tapered and may extend over approximately 20% of the external length of the pins 16. A somewhat shorter or longer taper may be used. The tapered base region enhances the seal around the base of each pin when the male connector is fully engaged with a female connector. In addition, by allowing the rest of the pin shafts to have a slightly smaller diameter, this design makes it somewhat easier to make up the connection because the smaller diameter part of the pins is easier to insert into the corresponding female receptacles.

The internal sockets 56 shown in FIGS. 5 and 6 may have regions with different diameters. In a preferred embodiment, the part of the socket near the cable end is larger in order to more easily accommodate the wire connected to the pin. In the female component, the same configuration is preferred, with the only difference being that the wire is connected to a female receptacle, rather than a male pin. A smaller diameter region may then be used within the flexible insulator layer 44, which will enhance the seal around the shaft of a pin. A larger diameter region may be used at the point where the flexible layer 44 meets and is bonded to the rigid layer 46. This allows a correspondingly larger diameter part of the pin to seat firmly against the rigid insulator material 46 and tightly seal against the flexible insulator material 44. The larger diameter part of the pin may be pushed through the smaller diameter portion of the socket 56 because that portion is within the flexible insulator layer 44, which is sufficiently flexible to allow a slightly larger diameter portion of the pin to be forced through. The rigid material 46, on the other hand, will not allow the larger diameter part of the pin to be pushed through. The combination of different flexibility insulators and the varied diameter socket or pin/receptacle arrangement allows for a secure, sealed fit between the internal parts of the electrical contact (either pin or receptacle) and the insulator body.

Figure 7:
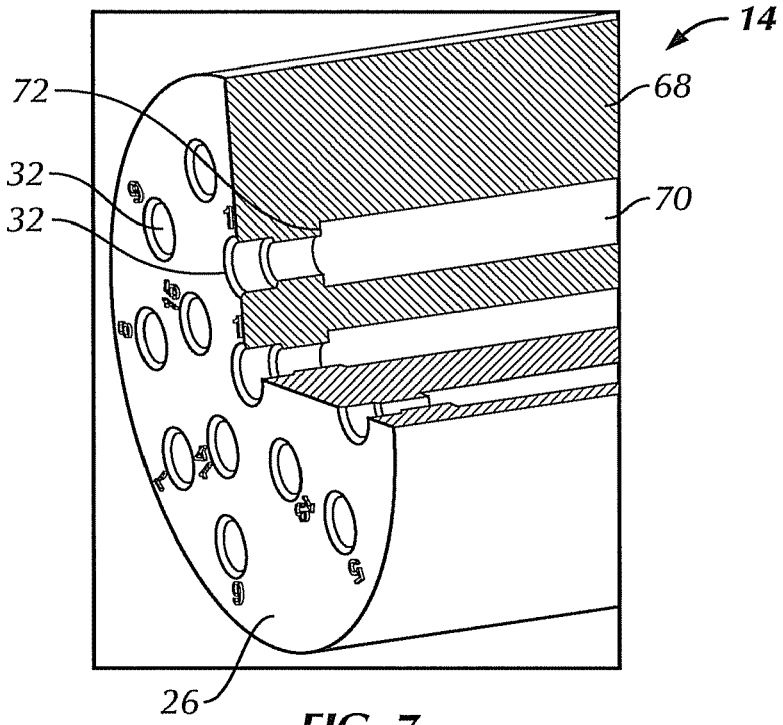
FIG. 7 is a cut-away illustration of part of the female component of the present invention.

FIG. 7 shows a cut-away part of a female component 14. Only a rigid insulator region 68 is shown, but the full female component 14 has a flexible insulator region at its cable end, similar to the configuration of the male cable end region explained above. Longitudinal sockets 70 run through the length of the female component 14. A larger diameter region 72 is shown starting somewhat near the female contact end 26. This larger region 72 is used to provide space for the cylindrical spring sleeve 78 shown in FIG. 4. There are beveled openings 32 at the contact end 26 of the female component. The flexible seals 30 of the male component 12 seat against the beveled openings 32 when the connector is made up.

Figure 8:
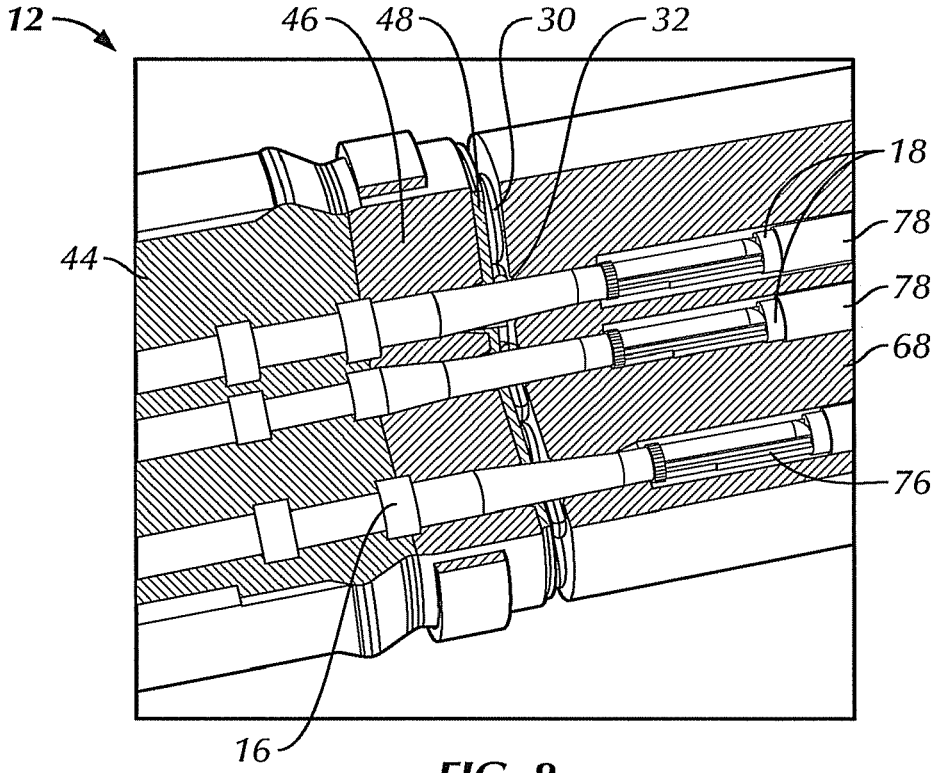
FIG. 8 is a cut-away illustration of the male-to-female interconnection of the present invention.

FIG. 8 shows a cut-away of a male component 12 and female component 14 connected together. This drawing is for illustration purposes only, as these two parts of the connector would be installed in rigid outer shells before the connector is made up and used. The three insulator layers of the male component are shown: the large flexible region 44, the rigid middle layer 46, and the thin, flexible later 48. The pins 16 are shown fully inserted into the receptacles 18. The flexible seals 30 are deformed radially outward and are seated against the beveled openings 32 of the female contact end 26.

The longitudinal slot 76 illustrated in detail in FIG. 4 may also be seen in FIG. 8. The slot 76 extends from the end of the receptacle positioned near the female contact end 26 to a point near or beyond the position of the tip of a male pin 16, when the pin 16 is fully inserted into the receptacle 18. This allows most or all of the contact region of the receptacle 18 to expand and contract slightly, thus enhancing the wiping of the pins 16 and improving the electrical connection (i.e., reducing the electrical resistance) between the pins 16 and receptacles 18. The slot may extend past the full pin-insertion point or may terminate near that point.

The rigid insulator region 68 of the female component 14 is also shown. FIG. 8 also shows the cylindrical spring sleeve 78 and part of the slotted region of the receptacles 18, though these two features are illustrated more clearly in FIG. 4.

Figure 9:
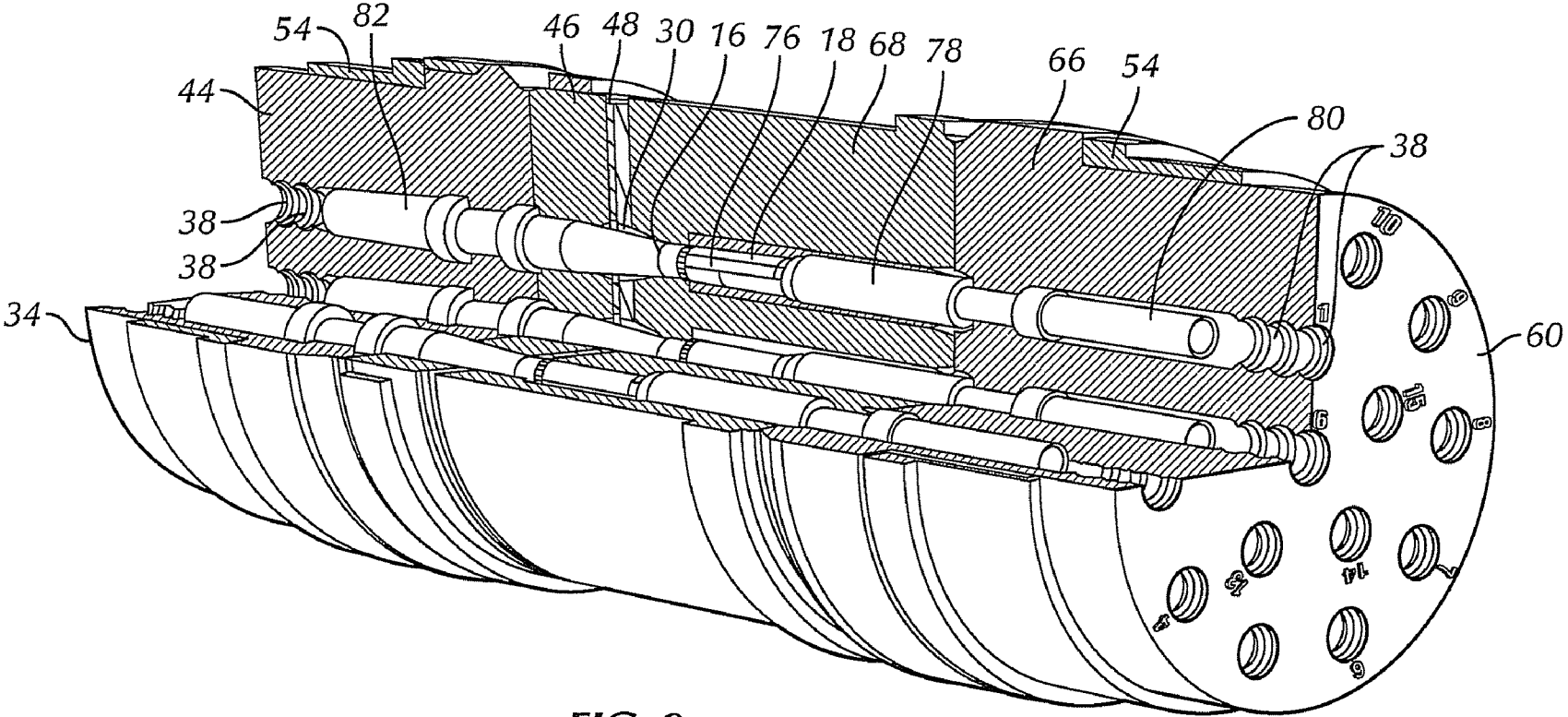
FIG. 9 is a cut-away of the full length (i.e., with male and female components connected) of the internal part of a connector made in accordance with the present invention.

FIG. 9 is a full-length version of the connection illustrated in FIG. 8. In addition to the features shown in FIG. 8, one can see the cable end components in FIG. 9. The male cable end 34 and female cable end 60 form the opposite ends of the connector. The flexible, cylindrical seals 38 within the sockets (56 and 70) are shown near the two cable ends.

The large flexible insulator region 66 of the female component 14 is shown, as is the rigid outer support ring 54, which is used in the same manner as described above for the male component 12. The receptacle wire connection end 80 and the pin wire connection end 82 also are shown. In practice, wires would be connected to the receptacles and pins, and a crimp connection is widely used, though other connecting methods are fully within the scope of the invention. Wires 26 (not shown) would then extend out from each end of the connector and would be sealed within the sockets by the flexible, cylindrical seals 38.

Figure 10:
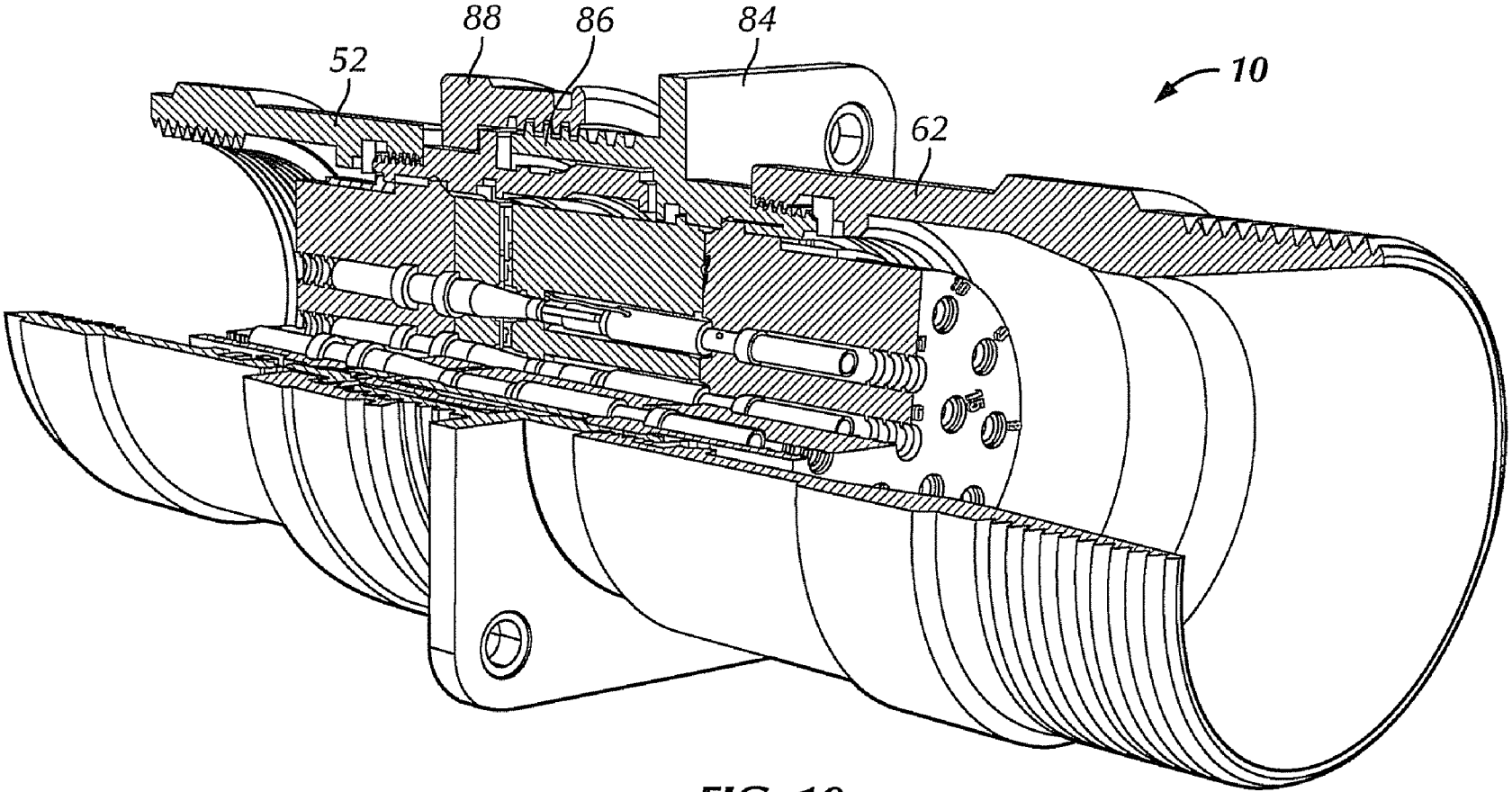
FIG. 10 is a cut-away of a connector of the present invention.

Finally, FIG. 10 shows a fully made up multi-pin connector 10. The male component 12 is installed within a first external shell 52, and the female component 14 is installed within a second external shell 62. The external shells are typically made of steel, but any suitable, rigid material may be used. A mounting flange 84 is shown as part of the second external shell 62, and allows the female component 14 to be mounted to a panel.

This configuration is entirely optional, but illustrates the variety of applications in which the invention could be used. It could be a cable to cable connection, for example, to extend the length of a multi-line cable run. The invention also may be used in panel-mounted applications, included panels of machines or other equipment. In addition, the invention could be used as a single, cable-end connector, in either male or female form, and configured to be plugged into an existing multi-pin receptacle installed on an existing instrument, machine, control panel, or other item.

Multi-pin connections are somewhat common on a variety of control, instrumentation, and data processing equipment. A connector embodying the present invention may be beneficially used at the end of a cable that is to be connected to these types of equipment. For example, where data processing equipment is used in an oilfield operation, there may be an increased risk of water infiltrating into connectors. A multi-pin connector embodying the present invention may be used to eliminate the problem of cross-talk in this type of application, which could have substantial benefits.

It also should be understood that the present invention may be a complete connector—that is, both male and female components—or just the male or female component. Consider, for example, an existing multi-pin connection installed in a panel of some piece of equipment, a control or instrumentation panel, or any other application. If that connection has been suitably designed to prevent water intrusion, use of a cable-end connector in accordance with the present invention may be sufficient to eliminate the cross-talk resulting from water infiltration. To be more specific, in this type of application, the cable-end connector would prevent water from shorting any of the live contact surfaces within the cable-end connector, and may also provide water-tight seals around the pin connections between the cable-end connector and the installed panel connection.

Single connectors (i.e., either male or female alone) embodying the present invention also may be used with prior art connectors. The full benefits of the invention may not be realized in such applications, because the prior art connector may allow water infiltration, causing shorting within the prior-art connector. Nevertheless, using one connector with the advantages of the present invention may eliminate some sources of possible water-based shorting, and thus, reduce the risk of cross-talk. In addition, connectors embodying the present invention provide all the ordinary functionality of other multi-pin connectors, and thus can be used interchangeably with such connectors. By replacing prior art connectors with the more protected connectors of the present invention, one can enhance the reliability of a system and reduce the overall risk of cross-talk. Eliminating or isolating any pockets of water, as accomplished by the present invention, may be beneficial in a wide variety of settings. The invention claimed below is not limited to any particular application.

FIG. 10 also shows external securing threads 86 on the female component 14, and a threaded securing ring 88 is shown on the male component 12. Other methods of obtaining a secure connection are fully within the scope of the invention, including the use of no additional securing mechanism. In many settings, the fitting between the male and female components may be sufficient. The embodiment shown in FIG. 10 is suitable for use in extreme conditions, such as those experienced in offshore oil or gas drilling operations. In the configuration shown, the ring 88 is threaded onto the external threads 86 and then tightened, thus pulling the male and female components together in a secure manner.

While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

I claim:

1. A male multi-pin electrical connector comprising:

a. a cable end;

b. a contact end opposite the cable end;

c. an insulator body having, i. a first layer of flexible insulator material beginning at the contact end;

ii. a second layer of flexible insulator material beginning at the cable end;

iii. a layer of rigid insulator material positioned between and permanently bonded to the first layer of flexible insulator material and the second layer of flexible insulator material;

iv. multiple, longitudinal, internal sockets extending from the cable end to the contact end; and, v. at least one internal, flexible, cylindrical seal located within each of the multiple, longitudinal, internal sockets, the internal seal positioned near the cable end;

d. multiple, longitudinal pins, wherein each pin is positioned within each socket and each pin i. extends through the layer of rigid insulator material;

ii. extends partially into the second layer of flexible insulator material; and, iii. extends through the first layer of flexible insulator material and outwardly from the contact end; and, e. multiple, flexible seals, wherein each seal is connected to the contact end and positioned around a portion of each pin.

2. The connector of claim 1, further comprising a rigid outer ring positioned around a portion of the second layer of flexible insulator material.

3. The connector of claim 1, wherein the first layer of flexible insulator material is thinner than the second layer of flexible insulator material.

4. The connector of claim 3, wherein the layer of rigid insulator material is thicker than the first layer of flexible insulator material and is thinner than the second layer of flexible insulator material.

5. The connector of claim 1, wherein the outwardly extending portion of each of the multiple, longitudinal pins has a tapered base region located near the contact end.

6. A multi-pin electrical connector comprising:

a. a male component having i. a first cable end;

ii. a male contact end;

iii. multiple, longitudinal pins extending outwardly from the male contact end; and, iv. multiple, flexible seals, wherein each seal is connected to the male contact end and positioned around a portion of each pin, such that each seal forms a watertight seal around its respective pin when the connector is in use; and, b. a female component having i. a second cable end;

ii. a female contact end;

iii. multiple, longitudinal internal sockets extending from the second cable end to the female contact end, wherein each socket has a beveled opening at the female contact end; and, iv. multiple, longitudinal, female receptacles, wherein each receptacle is positioned within one of the multiple longitudinal internal sockets and is configured to receive one of the multiple, longitudinal pins of the male component, and wherein each female receptacle has a first end positioned near the female contact end;

a full pin-insertion point, which is located at a position on the receptacle corresponding to the position of a tip of the male pin when the pin is fully inserted into the receptacle; and a longitudinal slot extending inwardly from the first end of the receptacle to a location near or beyond the full pin-insertion point; and, multiple, cylindrical, spring sleeves, wherein each spring sleeve is positioned around at least a portion of the longitudinally slotted part of each receptacle and is biased to exert a radially inward force upon the longitudinally slotted part of each receptacle.

7. The connector of claim 6, wherein the male component further comprises an insulator body having, a. a first layer of flexible insulator material beginning at the contact end;

b. a second layer of flexible insulator material beginning at the cable end; and, c. a layer of rigid insulator material positioned between and permanently bonded to the first layer of flexible insulator material and the second layer of flexible insulator material.

8. The connector of claim 7, wherein the first layer of flexible material is thinner than the second layer of flexible material.

9. The connector of claim 8, wherein each of the multiple longitudinal pins extends through the first layer of flexible insulator material and the layer of rigid insulator material, but extends only partially into the second layer of flexible insulator material.

10. A male multi-pin electrical connector comprising:

a. a cable end;

b. a contact end opposite the first cable end;

c. multiple, longitudinal, pins extending outwardly from the contact end of the connector;

d. multiple, flexible seals, wherein each seal is connected to the contact end and positioned around a portion of each longitudinal pin, such that each seal forms a watertight seal around its respective pin when the connector is in use; and, e. an insulator body having, i. a first layer of flexible insulator material beginning at the contact end;

ii. a second layer of flexible insulator material beginning at the cable end;

iii. a layer of rigid insulator material positioned between and permanently bonded to the first layer of flexible insulator material and the second layer of flexible insulator material.

11. The connector of claim 10, further comprising a rigid outer ring positioned around a portion of the second layer of flexible insulator material.

12. The connector of claim 10, wherein the first layer of flexible insulator material is thinner than the rigid layer of insulator material, and the rigid layer of insulator material is thinner than the second layer of flexible insulator material.

13. The connector of claim 10, wherein the outwardly extending portion of each of the multiple, longitudinal pins has a tapered base region located near the contact end.

14. A multi-pin electrical connector comprising:

a. a cable end;

b. a contact end opposite the cable end;

c. a cable end layer of flexible insulator material beginning at the cable end;

d. a layer of rigid insulator material permanently bonded to the cable end layer of flexible insulator material;

e. multiple, longitudinal, internal sockets extending from the cable end to the contact end; and, f. at least one internal, flexible, cylindrical seal within each of the multiple, longitudinal, internal, sockets, wherein the seal is located within the cable end layer of flexible insulator material and positioned near the first cable end.

15. The connector of claim 14, further comprising a contact end layer of flexible insulator material beginning at the contact end and permanently bonded to the layer of rigid insulator material.

16. The connector of claim 15, wherein the contact end layer of flexible insulator material is thinner than the rigid layer of insulator material, and the rigid layer of insulator material is thinner than the cable end layer of flexible insulator material.

17. The connector of claim 15, further comprising a. multiple, longitudinal pins, wherein each pin is positioned within each socket and each pin extends outwardly from the contact end; and, b. multiple, flexible seals, wherein each seal is connected to the contact end and positioned around a portion of each pin.

18. The connector of claim 17, wherein the outwardly extending portion of each of the multiple, longitudinal pins has a tapered base region located near the contact end.

19. The connector of claim 14, further comprising a rigid outer ring positioned around a portion of the layer of flexible insulator material.

20. The connector of claim 14, further comprising multiple, longitudinal, female receptacles, wherein each receptacle is positioned within one of the multiple, longitudinal, internal sockets and has a. a first end positioned near the contact end; and, b. a second end positioned within the layer of flexible insulator material.

21. The connector of claim 20, further comprising a. a longitudinal slot in each of the multiple, longitudinal, female receptacles, the slot beginning at the first end of the receptacle and extending along less than the full length of the receptacle; and, b. multiple, cylindrical, spring sleeves, wherein each spring sleeve is positioned around at least a portion of each longitudinal slot.

22. The connector of claim 14, wherein each of the multiple, longitudinal, internal sockets further comprises at least one region with a greater diameter than the remainder of the socket and wherein the greater diameter region is located within the cable end layer of flexible insulator material.

23. A process of assembling a multi-pin connector comprising, a. forming a layer of flexible insulator material with multiple, internal sockets;

b. forming a layer of rigid insulator material with multiple, internal sockets;

c. permanently bonding the layer of flexible insulator material to the layer of rigid insulator material such that the internal sockets of each layer are aligned;

d. inserting multiple electrical contacts into the multiple sockets through the layer of flexible insulator material and then into the layer of rigid insulator material; and e. after all electrical contacts have been fully inserted, installing a rigid outer ring around a portion of the layer of flexible material.

24. The process of claim 23, wherein a. each of the multiple, internal sockets within the layer of flexible insulator material includes at least one region with a larger diameter than the remainder of the socket;

b. each of the multiple electrical contacts includes at least one region with a larger diameter than the rest of the contact; such that, c. the step of inserting the multiple electrical contacts into the multiple sockets includes pushing the larger diameter region of each electrical contact through the flexible insulator material until the larger diameter electrical contact region is positioned within the larger diameter region of the socket.

* * * * *